US006769508B1

(12) United States Patent
O'Connor

(10) Patent No.: US 6,769,508 B1
(45) Date of Patent: Aug. 3, 2004

(54) UNDERWATER AUDIO SYSTEM

(76) Inventor: Damian Victor O'Connor, 75 Moolyben Road, Brentwood Western Austrialia (AU), 6153

( * ) Notice: Subject to any disclaimer, the term of this patent is extended or adjusted under 35 U.S.C. 154(b) by 0 days.

(21) Appl. No.: 09/979,190

(22) PCT Filed: May 19, 2000

(86) PCT No.: PCT/AU00/00480

§ 371 (c)(1),
(2), (4) Date: Nov. 19, 2001

(87) PCT Pub. No.: WO00/72629

PCT Pub. Date: Nov. 30, 2000

(30) Foreign Application Priority Data

May 21, 1999 (AU) ..... PQ 0484

(51) Int. Cl.[7] ..... H04R 25/00

(52) U.S. Cl. ..... 181/129; 181/128; 379/175; 367/132; 381/370; 381/375

(58) Field of Search ..... 181/129, 128, 181/127, 126, 20, 21, 149; 381/370, 375, 376, 380, 383; 379/174, 175; 367/132; 340/850; 2/422, 423, 425

(56) References Cited

U.S. PATENT DOCUMENTS 4,404,434 A * 9/1983 Pelt et al. ..... 381/383
4,463,223 A * 7/1984 Yamanoi et al. ..... 381/383
4,538,034 A * 8/1985 French ..... 381/383
4,682,374 A * 7/1987 Geiser ..... 2/209
4,683,587 A * 7/1987 Silverman ..... 381/311
5,022,100 A 6/1991 Belanger ..... 2/422
5,086,789 A * 2/1992 Tichy ..... 128/866
5,136,555 A 8/1992 Gardos ..... 367/132
5,457,751 A * 10/1995 Such ..... 381/375
5,586,176 A 12/1996 Peck ..... 379/175
5,610,655 A * 3/1997 Wakabayashi et al. ..... 348/373
5,793,855 A 8/1998 Peck ..... 379/175
5,889,730 A 3/1999 May ..... 367/132
5,926,532 A 7/1999 Peck ..... 379/175
6,130,953 A * 10/2000 Wilton et al. ..... 381/375
6,298,249 B1 * 10/2001 Locarno et al. ..... 455/575.2
6,396,769 B1 * 5/2002 Polany ..... 367/131

FOREIGN PATENT DOCUMENTS

FR 2589048 A1 * 4/1987 ..... A42B/3/30

* cited by examiner

*Primary Examiner*—Robert Nappi
*Assistant Examiner*—Edgardo San Martin
(74) *Attorney, Agent, or Firm*—Duane Morris LLP

(57) ABSTRACT

An underwater audio system includes a framing having at least one speaker mounted thereon and at least one upwardly extending arm member. The arm member(s) are arranged to slide under the strap of a diver's mask in use and to be held in place between the strap and the diver's head. Two speakers mounted on the frame are arrange to be located adjacent a diver's ear when the arm members are in place under the strap of the diver's mask.

20 Claims, 3 Drawing Sheets

UNDERWATER AUDIO SYSTEM

BRIEF DESCRIPTION OF THE INVENTION

The present invention relates to an underwater audio system.

FIELD OF THE INVENTION

It is known for divers to desire the use of headphones whilst underwater. These may be for the purpose of receiving instructions or communicating with other divers or personnel on the surface. They may also be desired for other purposes such as listening to music while diving.

A known type of headset for divers includes speakers built into the sides of a standard diving hood. This type of arrangement where the speakers are held next to the diver's ear is necessary as standard ear-pieces that are inserted in the ear would be forced into the ear by water pressure causing damage to the ear. This known type of arrangement however has disadvantages in the time taken to put the headset on and to remove the headset. This may be important in situations where it is required to quickly remove the headset for safety reasons. For example, it may be necessary to quickly remove the headset if the headset cables become entangled.

The present invention overcomes at least in part some of the aforementioned disadvantages of previous underwater audio systems.

SUMMARY OF THE INVENTION

In accordance with one aspect of the present invention there is provided an underwater audio system characterised by including a frame having at least one water proof speaker mounted thereon and having at least one arm member arranged to slide under a strap of a diver's mask and be held in place between the strap and the diver's head.

DESCRIPTION OF THE DRAWINGS

The present invention will now be described, by way of example, with reference to the accompanying drawings, in which.

DESCRIPTION OF THE INVENTION

Figure 1:
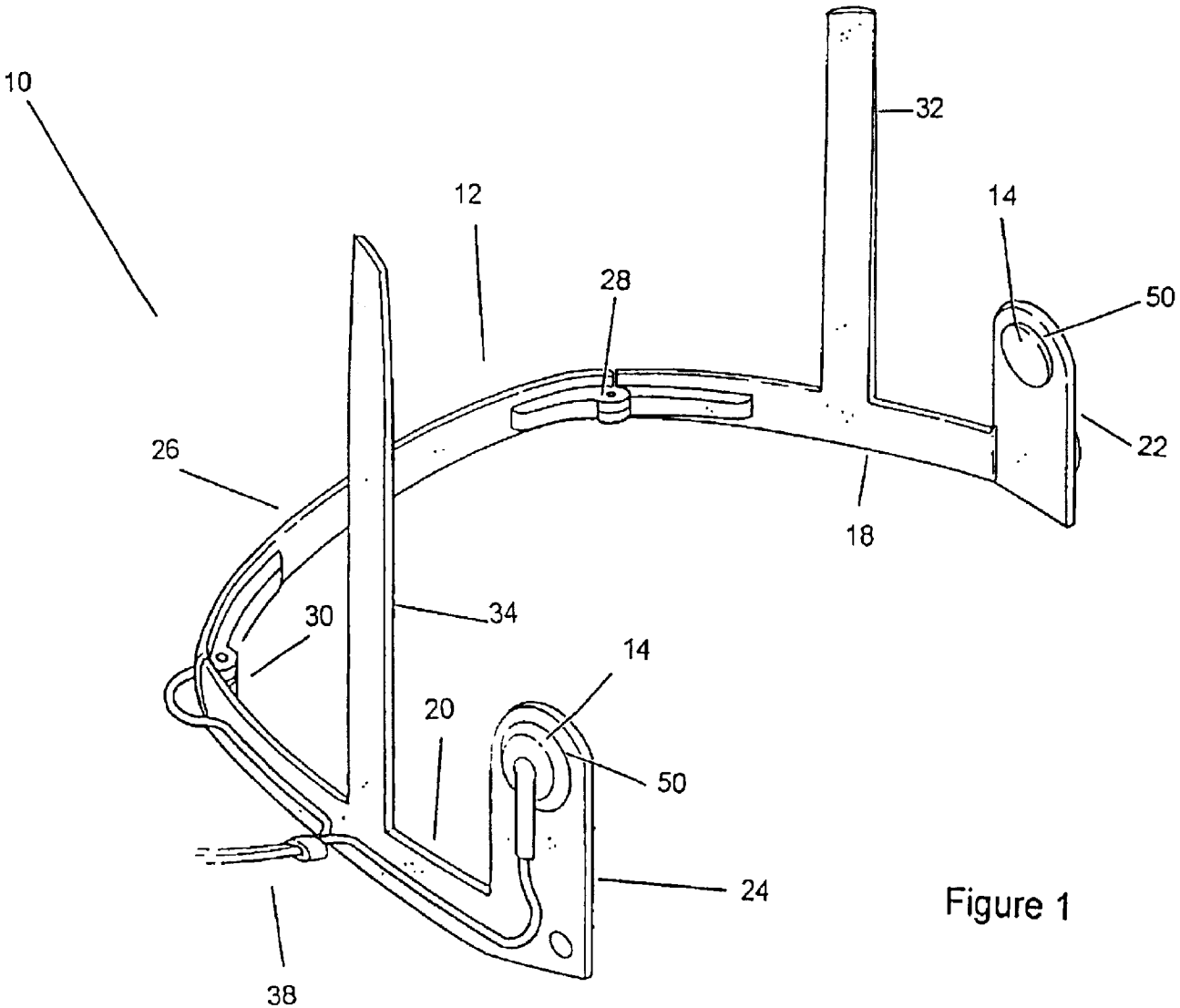
FIG. 1 is a perspective view of a headset of an underwater audio system in accordance with the present invention.
Figure 2:
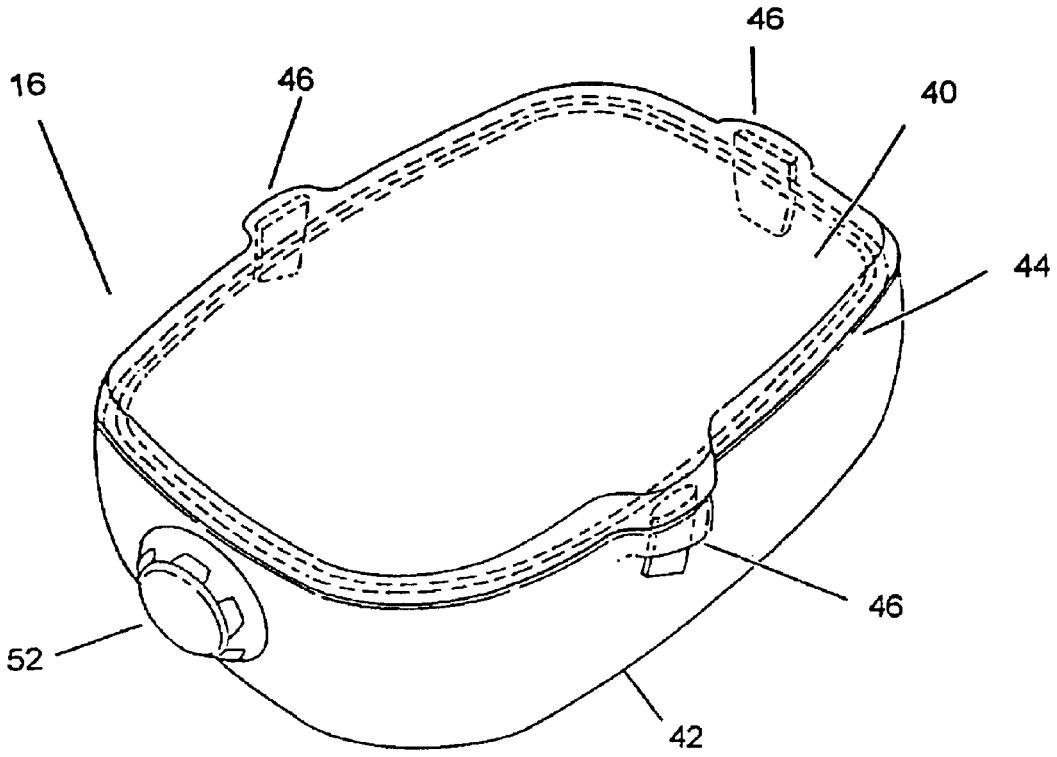
FIG. 2 is a perspective view of a waterproof housing of an underwater audio system in accordance with the present invention.

Referring to FIGS. 1 and 2, there is shown an underwater audio system 10 including a frame 12, speakers 14 and a housing 16. The frame 12 includes first and second side members 18 and 20. The first and second side members 18 and 20 are arranged generally parallel to each other, in use, at a distance such that they may rest either side of a diver's head. The first side member 18 includes a first transversely extending member 22 at a first end thereof. The second side member 20 includes a second transversely extending member 24 at a first end thereof. The frame 12 further includes a rear member 26. The rear member 26 is connected between second ends of the first and second side members 18 and 20 by first and second hinges 28 and 30 respectively. The first and second hinges 28 and 30 allow the first and second side members 18 and 20 to fold back so that they are generally parallel to the rear member 26 when not in use. Further the rear member 26 is curved to generally follow the shape of the tear of the diver's head.

The first and second side members 18 and 20 each include a respective arm member 32 and 34. The arm members 32 and 34 extend generally perpendicular to the respective side members 18 or 20 from a point intermediate the first and second ends of the side members 18 and 20. Each arm member 32 and 34 is arranged to be inserted under a strap of a diver's mask, adjacent to and behind the diver's ear. Preferably, each arm member 32 and 34 is twisted slightly at upper ends thereof to sit flat against the diver's head and be held securely between the strap of the diver's mask and the diver's head.

The first and second transversely extending members 22 and 24 each include an opening 50 at an upper end thereof. Each opening 50 is arranged to receive a speaker 14. The first and second transversely extending members 22 and 24 and speakers 14 are arranged such that when the arm members 32 and 34 are engaged with the strap of the diver's mask the speakers 14 are held adjacent the diver's ears.

The speakers 14, once inserted in the openings 50, are waterproofed by any convenient means. Cables 38 are provided to connect each speaker 14 to a portable audio device (not shown). The cables 38 are preferably secured to an outer surface of the corresponding transversely extending member 22 and 24 and side member 18 and 20.

A waterproof housing 16 is provided to house the portable audio device. The housing 16 includes a receptacle portion 42 and a removable cover 40. The removable cover 40 includes a seal member 44 and is arranged to be fastened to the receptacle portion 42 by a plurality of clamp means 46. The clamp means 46 may be any suitable clamping arrangement to produce a watertight seal between the receptacle portion 42 and the removable cover 40. In another embodiment, one of the clamp means 46 may be replaced by hinge.

The housing 16 also includes a first aperture (not shown) to receive the cables 38. The first aperture 48 is arranged to be sealed around the cables 38 to maintain the water proofing of the housing 16. The housing 16 further includes an attachment means (not shown) on a lower surface arranged for attachment to a portion of a diver's gear. For example, for connection to a diver's vest or belt.

Figure 3:
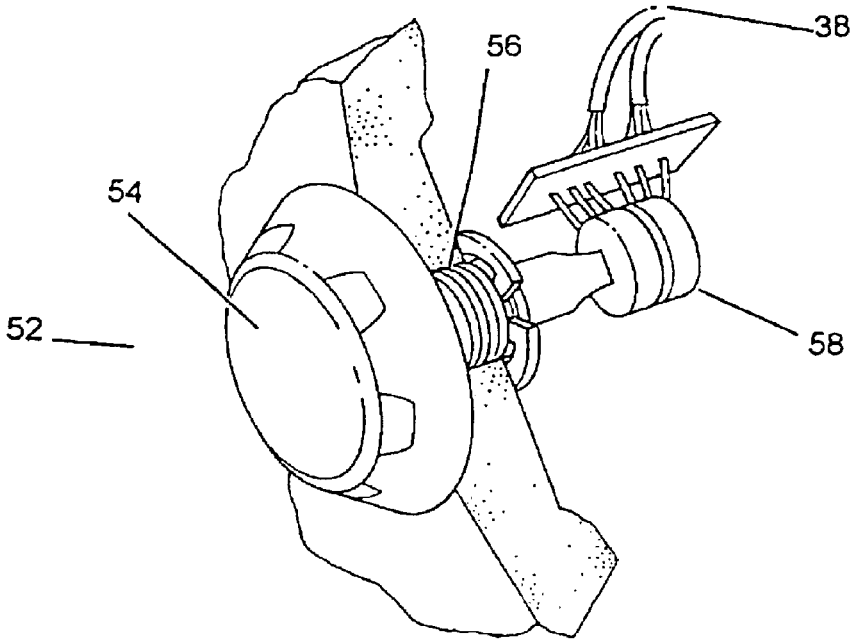
FIG. 3 is a perspective view of a volume control means of the waterproof housing of FIG. 2.

FIGS. 2 and 3 show a volume control means 52 for the underwater audio system 10. The volume control means 52 includes a rotatable member 54 arranged to be received in a second aperture 56 in the housing 16. The second aperture 56 includes a second seal member to prevent water from entering the housing 16 through the second aperture 56. The rotatable member 54 is connected to a variable resistor 58 included in the cables 38. Rotation of the rotatable member 54 varies the resistance in the cables 38 and hence the volume at the speakers 14.

Figure 4:
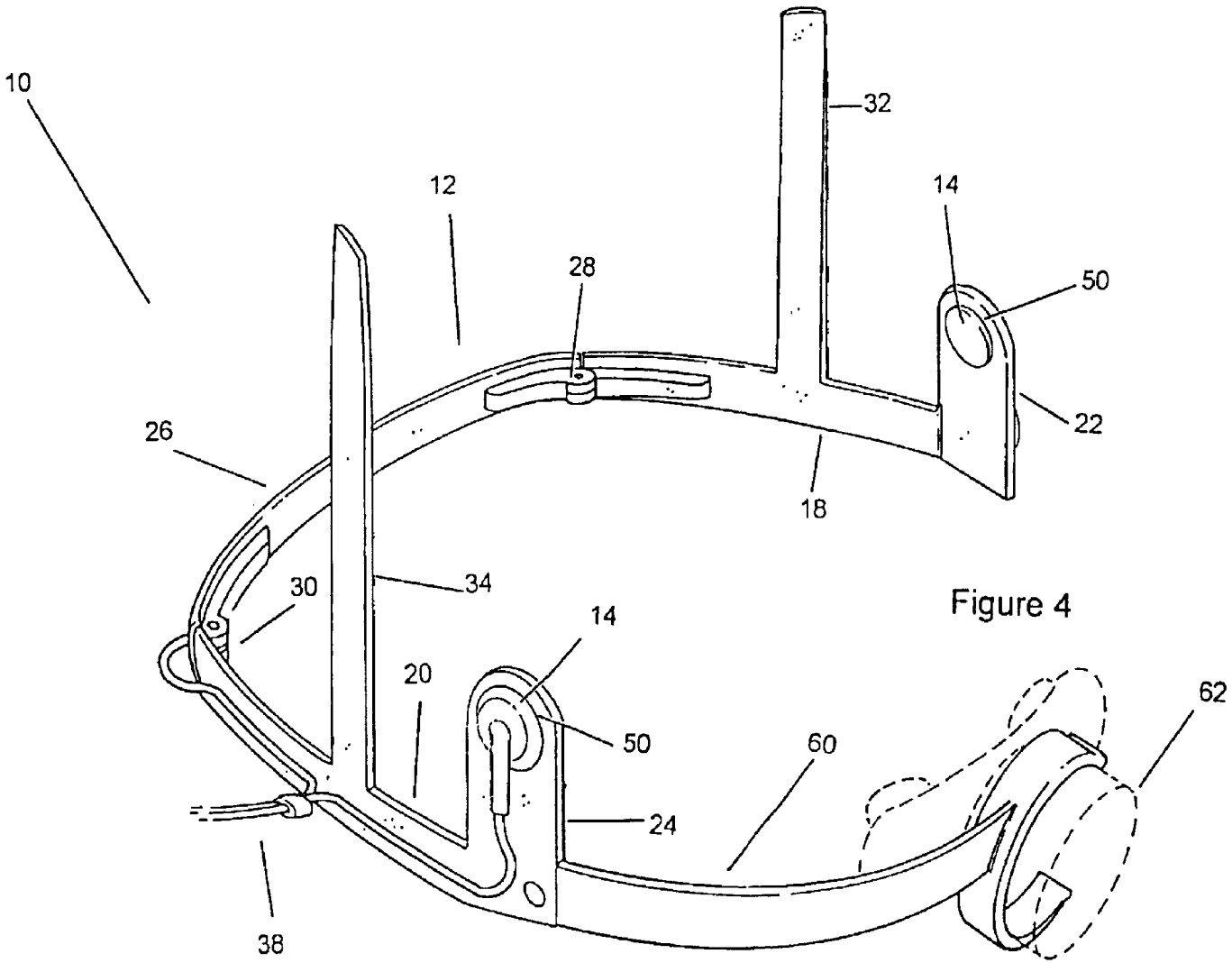
FIG. 4 is a perspective view of the headset of FIG. 1 including an audio input support member.

FIG. 4 shows an alternate embodiment of a frame 12 of an underwater audio system 10 wherein an audio input support member 60 is provided. The audio input support member 60 is arranged to be connected at a first end thereof to either the first or second side member 18 or 20. The audio input support member 60 is curved such that a second end thereof is positioned adjacent the diver's mouth. An audio input device 62 is mounted on the second end of the audio input support member.

In use, when the diver has completed putting on his necessary equipment, the portable audio device is placed in the waterproof housing 16. The cover 40 is then secured to the housing 16 via clamping means 46. The housing 16 may then be secured to the diver's vest by the attachment means.

The frame 12 is then placed around the diver's neck and the arm members 32 and 34 are slid under the strap of the diver's mask such that the speakers 14 are positioned alongside the diver's ears. The frame 12 may then be simply removed, if required, by pulling down on the frame 12 to disengage it from the strap of the mask.

Modifications and variations as would be apparent to a skilled addressee are deemed to be within the scope of the present invention.

I claim:

1. An underwater audio system comprising:

a frame having at least one water proof speaker mounted thereon and having first and second arm members, each said arm member being arranged to slide under a strap of a diver's mask adjacent to and behind a respective ear of the diver such that the frame is held in place by engagement of the first and second arm members between the strap and the diver's head.

2. An underwater audio system in accordance with claim 1, wherein the frame includes first and second side members, the first and second side members arranged to be positioned along a respective side of the diver's head.

3. An underwater audio system in accordance with claim 2, wherein the first side member includes the first arm members, the first arm member extending generally upwardly from the first side members from a point intermediate a first and a second end of the first side member and the second side member includes the second arm member, the second arm member extending generally upwardly from the second side member from a point intermediate a first and a second end of the second side members.

4. An underwater audio system in accordance with claim 3, wherein the first and second side members are each provided with transversely extending member at the first end thereof, upper ends of the transversely extending members being positioned in use adjacent a respective ear of the driver.

5. An underwater audio system in accordance with claim 4, wherein each of the transversely extending members has a speaker mounted adjacent the upper and thereof.

6. An underwater audio system in accordance with claim 3, wherein a rear member is provided, the rear member interconnecting the second ends of the first and second side members.

7. An underwater audio system in accordance with claim 6, wherein the first and second side members are pivotally connected to the rear member.

8. An underwater audio system in accordance with claim 2, wherein an audio input support member is provided, the audio input support member being attachable at a first end thereof to a first end of one of the first and second side member.

9. An underwater audio system in accordance with claim 8 wherein the audio input support member has a second end located adjacent the diver's mouth, the second end having an audio input device mounted thereon.

10. An underwater audio system in accordance with claim 1 wherein a waterproof housing is provided, the waterproof housing being adapted to contain a portable audio device.

11. An underwater audio system in accordance with claim 10 wherein a cable is provided to connect the waterproof speakers with the portable audio device, the cable being able to transmit an audio signal to the speakers.

12. An underwater audio system in accordance with claim 10, wherein the waterproof housing includes a cover, the cover being releasable from the waterproof housing to allow access to the portable audio device.

13. An underwater audio system in accordance with claim 10, wherein the waterproof housing includes an attachment means, the attachment means allowing the waterproof housing to be secured to a portion of a diver's gear.

14. An underwater audio system comprising:

a frame having at least one water proof speaker mounted thereon and having at least one respective arm member, the frame being arranged such that when said at least one arm member is slid under a strap of a diver's mask adjacent to and behind a respective ear of the diver, the respective water proof speaker is held adjacent the ear of the diver.

15. The underwater audio system in accordance with claim 14, wherein the frame includes first and second side members and first and second arm members extending from respective side members, the first and second side members arranged to be positioned along respective side of the diver's head.

16. The underwater audio system in accordance with claim 15, wherein the first arm member extends generally upwardly from the first side member from a point intermediate a first and a second end of the first side member and the second arm member extends generally upwardly from the second side member from a point intermediate a first and a second end of the second side member.

17. The underwater audio system in accordance with claim 15, wherein the first and second side members are each provided with a transversely extending member at a first end thereof, upper ends of the transversely extending members being positioned in use adjacent a respective ear of the diver.

18. The underwater audio system in accordance with claim 17, wherein each of the transversely extending members has a speaker mounted adjacent the upper end thereof.

19. An underwater audio system in accordance with claim 15, wherein a rear member is provided, the rear member interconnecting the second ends of the first and second side members.

20. An underwater audio system in accordance with claim 19, wherein the first and second side members are pivotally connected to the rear member.

* * * * *